United States Patent [19]

Yamazaki

[11] 3,965,384

[45] June 22, 1976

[54] IGNITION PLUG FOR USE IN INTERNAL COMBUSTION ENGINES

[76] Inventor: Kazue Yamazaki, c/o Mrs. Chiyo Toyoda, 17-34, Shakujii-cho 6-chome, Nerima, Tokyo, Japan

[22] Filed: May 22, 1974

[21] Appl. No.: 472,386

[30] Foreign Application Priority Data

July 18, 1973 Japan ..... 48-81067

[52] U.S. Cl. ..... 313/142; 313/140

[51] Int. Cl.[2] ..... H01T 13/20

[58] Field of Search ..... 313/118, 142, 140, 141

[56] References Cited

UNITED STATES PATENTS

| | | | |
|---|---|---|---|
| 1,384,818 | 7/1921 | Bathurst | 313/142 X |
| 2,833,265 | 5/1958 | Hindle et al. | 313/118 X |
| 3,171,396 | 3/1965 | Vidal | 313/118 X |

*Primary Examiner*—R. V. Rolinec
*Assistant Examiner*—Darwin R. Hostetter
*Attorney, Agent, or Firm*—Wolder & Gross

[57] ABSTRACT

An internal combustion engine spark plug including an outer metal shell, a central electrode and a side electrode extending from the shell toward the central electrode to form a spark gap is provided with an open element formed of rigid metal wire resistant to the spark plug ambient use conditions, the member surrounding the spark gap and being spaced from the spark gap a distance at least equal to the width of the spark gap. Among the forms of the wire member are a pair of U-shaped wire members each having at least one leg secured to the shell and a horizontal linear cross leg parallel to and coplanar with the side electrode, two pair of such members arranged in quadrative with the cross legs forward of the side electrode, the members may have thinner wire wrapped about its legs, and an element including a pair of laterally spaced L-shaped wire members with the vertical legs connected to the shell and an intermediate L-shaped member formed of twisted wire with a horizontal leg underlying the side electrode. The wire forming the element is thinner than the electrodes and is formed of Cr, Mo, W, Ni, Ir, Pt, Au, Co or Al or alloys thereof.

13 Claims, 4 Drawing Figures

IGNITION PLUG FOR USE IN INTERNAL COMBUSTION ENGINES

Figure 1:
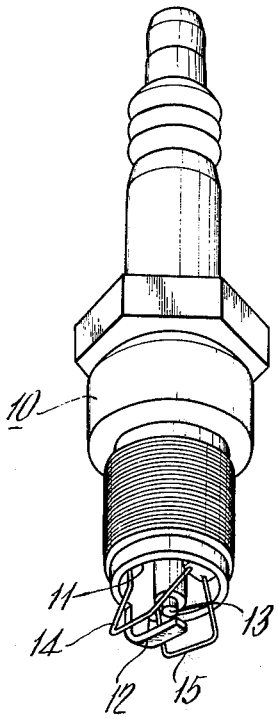

The present invention relates generally to improvements in spark or ignition plugs for use in internal combustion engines, and it relates more particularly to an improved novel ignition plug which effects an increase in the combustion efficiency of the fuel in the combustion chamber of the engine and concurrently reduces the amounts of pollutant and toxic gasses contained in the engine exhaust.

Air pollution resulting from the discharge into the atmosphere of the exhaust gasses from automotive vehicles and other internal combustion engines has, for a number of years, been a serious problem to the public health. It is, therefore, highly desirable to reduce the amounts of toxic and noxious gasses generated in the combustion chamber and exhausted into the atmosphere. Although many attempts have been made to overcome this air pollution problem, no successful results have been obtained without a serious reduction in the overall combustion efficiencies of the engine.

It is well known that the exhaust gasses of the internal combustion engine primarily contain three groups of toxic gasses which are considered to be the main cause of air pollution problems. The first group is composed of the oxidation products of sulfur including sulfur dioxide, the second is composed of incompletely burned products, including unburned hydrocarbons and carbon monoxide, and the third group is composed of nitrogen oxides which are produced during the combustion period when the temperature in the combustion chamber is locally exceedingly high.

Among the above groups of toxic gasses, the amount of the oxidation products of sulfur can be reduced to suitable levels by lowering the sulfur contents of the fuel. However, it is extremely difficult to concurrently reduce the quantities of incompletely burned products and those of the nitrogen oxides. The amounts of the nitrogen oxides generated in the combustion chamber are unavoidably increased when combustion is effected at high temperature or at the high air fuel ratios required to reduce the amounts of incompletely burned products. On the contrary, when combustion is effected at relatively low temperatures and at low air fuel ratios in order to reduce the amounts of nitrogen oxides, complete combustion of the fuel is not attainable, and there accordingly results an appreciable depression in the engine combustion efficiency accompanied by a corresponding decrease in the engine power output. Incomplete combustion also contributes to the formation of toxic carbon monoxide and unburned hydrocarbons.

It is, therefore, a primary object of the present invention to provide an improved ignition or spark plug of novel construction which is effective in improving the fuel combustion efficiency in the combustion chamber of an internal combustion engine.

It is another object of the present invention to provide an improved ignition plug which is capable of concurrently reducing the levels of the amounts of incompletely burned products and those of nitrogen oxides.

It is a further object of the present invention to provide an improved ignition plug which is effective in decreasing the fuel consumption of an internal combustion engine.

It is a further object of the present invention to provide an improved ignition plug of the aforementioned nature which is simple in its construction and easily applied as a practical modification to conventional ignition plugs.

Figure 2:
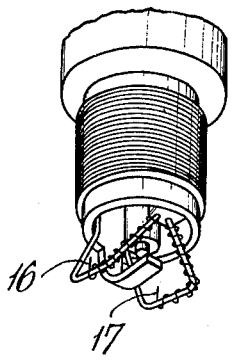
Figure 3:
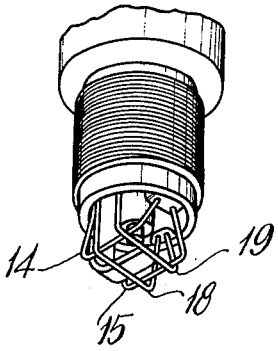
Figure 4:
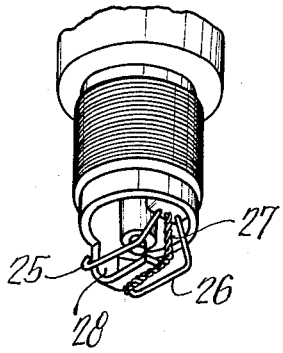

The above and other objects and advantages of the present invention will become apparent from a reading of the following description taken in conjunction with the appended drawing, wherein:

FIG. 1 is a perspective view of a preferred embodiment of this invention; and FIGS. 2 to 4 are perspective views of the lower portions of other plugs embodying the present invention.

The present invention contemplates the provision of an ignition plug having one or a plurality of relatively thin wires made of a formed rigid metal or alloy which is disposed in the vicinity of the spark or discharge gap in such a manner that the area delineated by the wire or plurality of wires surrounds the spark gap formed between the center electrode and the side electrode of the plug. At least one end of the wire is secured to the metal shell of the spark plug and the wire or group of wires is formed such that all portions of the wire are spaced from the center electrode by a distance greater than that of the side electrode. In other words, the shortest distance between the formed wire and the center electrode is greater than the spark gap.

The rigid metals or alloys which may be used for the wires in the plug of the present invention are materials having high melting temperatures or points, and sufficient rigidity to withstand the periodic explosions occurring in the combustion chamber and vibrations and shock caused by the vehicle travel. It is to be noted that the formed wire should not contact the side and center electrodes of the plug and that the space between the formed wire and the center electrode should be maintained at a distance greater than that of the spark gap through the duration of ignition.

Metals or alloys which are preferrably used for the wires in the improved plug are materials conventionally employed as hydrogenation catalysts or as catalysts for water-gas reactions, such as chromium, molybdenum, tungsten, nickel steel, nickel, irridium or platinum. Alloys containing gold, copper or aluminum can also be used for the formed wire which is employed in the spark plug of the present invention. The optimum diameter of the wire varies in accordance with the metal or alloy forming the wires and the employed configuration of the formed wire. The wire is not necessarily composed of a single filament, but may be a twisted wire composed of a plurality of the same kind or different kinds of fibrous filaments.

Referring now to the drawing, more particularly FIG. 1 thereof which shows a preferred embodiment of the present invention, the reference numeral 10 generally designates the improved ignition plug which comprises a metal shell 11 of known construction, a center electrode 13 electrically separated from the metal shell and axially supported by a ceramic core, and a side electrode 12 extending from one side of the metal shell 11 and including a leg extending toward the center electrode 13 and spaced therefrom by a spark or discharge gap. A wire component includes a pair of shaped wire members 14 and 15 secured to one side of the metal shell 11 at each end thereof. The other ends of the shaped wire members 14 and 15 are inserted into the opposite peripheral portions of the metal shell 11, and thus the wire members 14 and 15 are in the form of loops the side elevation of which are of approximate square U-shaped configuration. The bottom leg of each loop extends substantially linearly horizontally, and distances between the formed wire members and the center electrode are greater than twice the discharge or spark gap between the electrodes.

FIG. 2 shows the lower portion of another embodiment of the present invention, wherein there are wound on the legs of the wire members 14 and 15, respectively, thin subsidiary wires 16 and 17, the free ends of which project upwardly from the central portions of the substantially horizontal bottom cross legs of the loop shaped wire members 14 and 15.

In the embodiment shown in FIG. 3, there are secured to one side of the metal shell a pair of wire members 14 and 15 having side elevations of square U-shaped configuration, the bottom cross legs of which extend substantially parallel to the horizontally extending leg or portion of the side electrode 12, and another pair of wire members 18 and 19 having side elevations of square U-shaped configuration, the bottom horizontal cross legs of which extend substantially perpendicularly to wire members 14 and 15. Both pair of wire members intersect each other to thus form coarse meshes over the spark gap. Alternatively, rigid coarse wire netting is secured to the metal shell 11 so that it surrounds the spark gap. By employing rigid coarse wire netting, an improved vibration proof or shock proof ignition plug is obtained. However, the mesh size of the wire netting should not be exceedingly small. When the spark gap is shielded by a wire netting of exceedingly small mesh size which prevents the propagation of combustion flame, burning conditions in the combustion chamber deteriorate.

FIG. 4 shows the lower portion of a yet further embodiment of the present invention, which includes metal wire members 25 and 26 having side elevations of L-shaped configuration and secured to the metal shell on its inner periphery diametrically opposite to the vertical or base portion 28 of the side electrode 12. The wire members 25 and 26 include bottom legs substantially parallel to the horizontally extending portion of the side electrode such that the bottom legs of the wire members 25 and 26 and the side electrode 12 are located substantially in the same plane and in spaced relationship to each other. Secured to the metal shell 11 is a twisted metal wire member 27 extending substantially from the same position at which the wire members 25 and 26 are secured and bending substantially horizontally over the side electrode 12. All portions of the wire members 25, 26 and 27 are within the longitudinally extended space of the outer periphery of the metal shell 11, so that they do not abut against other members in their mounting and demounting operation. Distances between the center electrode 13 and all portions of the wire members 25, 26 and 27 are greater than the spark gap. A rigid metal or alloy is employed for the wire members 25, 26 and 27 so that they do not come into contact with the center or side electrode when the plug is subjected to the ambient conditions accompanying the use of the plug including vibrations and/or explosions.

When the improved ignition plug of the present invention is used with an internal combustion engine of any form, burning conditions in the combustion chamber are markedly improved and the combustion efficiency of the fuel is significantly increased. As a result, the fuel consumption of the engine is suprisingly decreased.

Further advantages produced by the employment of the improved ignition plug of the present invention are that the amounts of incompletely burned products and those of nitrogen oxides contained in the exhaust gasses are concurrently reduced.

The advantages of the present invention, as described above, are hereinafter illustrated by way of a few comparison test results.

COMPARISON TEST RESULT (I)

An improved ignition plug according to the present invention was produced by disposing tungsten wires of 0.4 mm in diameter having the configuration as illustrated in FIG. 1 in the vicinity of the spark gap of a conventional ignition plug. The thus prepared improved ignition plug was inserted into each cylinder of a four-cylinder automotive internal combustion engine, and the engine was then submitted to road testing on a chassis-dynamometer. For purposes of comparison, road testing was conducted on the same automotive engine with conventional ignition plugs under the same testing conditions. The testing conditions were as follows:

| | |
|---|---|
| Temperature of the atmosphere: | 20°C |
| Relative humidity of the atmosphere: | 73% |
| Model number of the engine: | DATTONSAN P510 |
| Total amounts of exhaust gasses: | 1595 cc |
| CO content of the exhaust gas at idle: (with conventional plugs) | 3.3% |
| Properties of the fuel used: | |
| Octane value | 91.2 |
| Content of tetraethyl lead | 0.12 ml/l |
| Specific gravity | 0.7389 |
| Test result of fractional distillation | |
| 50% | 90.5°C |
| 90% | 153.0°C |
| 95% | 165.0°C |
| end point | 190.0°C |

The concentrations of CO, HC (hydrocarbons calculated in terms of hexane) and $NO_x$ contained in the exhaust gasses were measured. The data thus obtained were multiplied by coefficients illustrated in the following table depending, on their operation modes.

| Operation Mode | Coefficient |
|---|---|
| Idle | 0.11 |
| Acceleration (0 – 40 km/h) | 0.35 |
| Normal cruising (40 km/h) | 0.52 |
| Deceleration (40 – 0 km/h) | 0.02 |

Table 1 shows the measured and calculated test data of the engines with conventional plugs and with the improved plugs of the present invention.

Table 1

| Plug used | Mode | Concentrations of exhausted gases | | | Fuel consumption |
|---|---|---|---|---|---|
| | | CO (%) | HC (ppm) | $NO_x$ (ppm) | (cc/5 cycles) |
| Conventional | Idle | 0.37 | 132 | 9 | |
| Plug | Acceleration | 0.40 | 349 | 416 | 265 |

Table 1-continued

| Plug used | Mode | Concentrations of exhausted gases CO (%) | HC (ppm) | $NO_x$ (ppm) | Fuel consumption (cc/5 cycles) |
|---|---|---|---|---|---|
| | Normal cruising | 0.11 | 341 | 1192 | |
| Deceleration | 0.03 | 38 | 34 | | |
| Improved Plug | Idle | 0.34 | 123 | 8 | |
| | Acceleration | 0.42 | 342 | 312 | |
| | Normal cruising | 0.07 | 340 | 1000 | 253 |
| | Deceleration | 0.03 | 38 | 34 | |

It will be apparent from Table 1 that with the employment of the improved plugs of the present invention the fuel consumption of the engine was decreased by about 5% when compared to the case in which conventional ignition plugs were employed, the carbon monoxide contents of the exhaust gasses at normal cruising speed was decreased by about 36%, and the nitrogen oxides contents of the exhaust gasses at the acceleration and normal cruising periods were decreased respectively, by 25% and 16%. These results are highly significant in view of the fact that large amounts of carbon monoxide and nitrogen oxides are emitted from the engine at the acceleration and normal cruising periods.

COMPARISON TEST RESULT (II)

An improved ignition plug according to the present invention was prepared by disposing tungsten wires of 0.4 mm in diameter having the configuration illustrted in FIG. 3 in the vicinity of the spark gap of a conventional plug. The thus prepared improved ignition plug was inserted into each cylinder of a four-cylinder automotive engine, and the engine was submitted to road testing on a chassis-dynamometer. Road testing was also conducted on the same automotive engine with conventional ignition plugs under the same testing conditions. The testing conditions are shown below:

| | |
|---|---|
| Temperature of the atmosphere: | 25.5°C |
| Relative humidity of the atmosphere: | 76 % |
| Model number of the engine: | DATTOSAN P510 |
| Total amounts of exhaust gasses: | 1595 cc |
| CO content of exhaust gasses at idle: (with conventional plugs) | 2.4 % |
| Properties of the fuel used: | |
| Octane value | 91.0 |
| Gum content | 1 mg/100 cc |
| Specific gravity | 0.7406 |
| Test result of fractional distillation | |
| initial boiling point | 29.0°C |
| 10 % | 45.0°C |
| 50 % | 102.0°C |
| 90 % | 161.0°C |
| 95 % | 179.0°C |
| end point | 204.0°C |

The concentrations of CO, HC (hydrocarbons calculated in terms of hexane) and $NO_x$ contained in the exhausted gasses were measured. Table 2 shows the measured test data of the engines with conventional plugs and the improved plugs of the present invention.

Table 2

| Plug used | Mode | Concentrations of exhausted gasses CO (%) | HC (ppm) | $NO_x$ (ppm) | Fuel consumption (cc/3 cycles) |
|---|---|---|---|---|---|
| | Idle | 2.33 | 1005 | 90 | |
| Conventional | Acceleration | 0.97 | 943 | 1925 | |
| Plug | Normal cruising | 0.48 | 683 | 2146 | 136 |
| | Deceleration | 1.50 | 2120 | 1037 | |
| Improved | Idle | 2.32 | 984 | 97 | |
| Plug | Acceleration | 0.96 | 932 | 1946 | |
| | Normal cruising | 0.47 | 681 | 1905 | 123 |
| | Deceleration | 1.23 | 2440 | 943 | |

It is apparent from Table 2 that by the employment of the improved ignition plugs of the structure shown in FIG. 3 fuel consumption of the engine was decreased by about 10% when compared to the case in which conventional ignition plugs were employed, the carbon monoxide content of the exhaust gasses at normal cruising was decreased by about 2%, and the nitrogen oxides content of the exhaust gasses at normal cruising was reduced by about 13%.

COMPARISON TEST RESULT (III)

An improved ignition plug according to the present invention was prepared by employing the configuration shown in FIG. 4. Tungsten wires of 0.4 mm in diameter were used as metal wire members 25 and 26 designated in FIG. 4, and a twisted tungsten wire including two tungsten filaments of 0.3 mm in diameter as used as the mtal wire member 27 designated in FIG. 4. The thus prepared improved ignition plug was inserted into each cylinder of a four-cylinder automotive engine, and the engine was submitted to road testing on a chassis-dynamometer. Road testing was also conducted on the same automotive engine with conventional ignition plugs under the same testing conditions. The testing conditions are as follows:

| | |
|---|---|
| Temperature of the atmosphere: | 21.0°C |
| Relative humidity of the atmosphere: | 82 % |
| Model number of the engine: | DATTOSAN P510 |
| Total amounts of exhaust gasses: | 1595 cc |
| CO content of exhaust gasses at idle: (with conventional plugs) | 2.45 % |

-continued

| | |
|---|---|
| Properties of the fuel used: | |
| Octane value | 91.0 |
| Gum content | 1 mg/100 cc |
| Specific gravity | 0.7406 |
| Vapor pressure at 37.8°C | 0.78 kg/cm² |
| Test result of fractional distillation | |
| initial boiling point | 29.0°C |
| 10 % | 45.0°C |
| 50 % | 102.0°C |
| 90 % | 161.0°C |
| 95 % | 179.0°C |
| end point | 204.0°C |

The concentrations of CO, HC (hydrocarbons calculated in terms of hexane) and $NO_x$ contained in the exhaust gasses were measured. Table 3 shows the measured test data of the engines with the conventional plugs and the improved plugs of the present invention.

Table 3

| Plug used | Mode | Concentrations of exhausted gasses | | | Fuel consumption (cc/3 cycles) |
|---|---|---|---|---|---|
| | | CO (%) | HC (ppm) | $NO_x$ (ppm) | |
| | Idle | 2.01 | 1458 | 94 | |
| Conventional | Acceleration | 1.11 | 1017 | 1796 | |
| | | | | | 148 |
| Plug | Normal cruising | 0.37 | 761 | 2342 | |
| Deceleration | 0.74 | 2524 | 1041 | | |
| Improved | Idle | 1.78 | 1271 | 96 | |
| Plug | Acceleration | 1.00 | 956 | 1554 | |
| | | | | | 133 |
| | Normal cruising | 0.24 | 742 | 2152 | |
| | Deceleration | 0.71 | 2399 | 804 | |

It is apparent from Table 3 that with the employment of the improved ignition plugs of the present invention shown in FIG. 4 the fuel consumption of the engine was decreased by about 10% when compared to the case in which conventional ignition plugs are employed, that the carbon monoxide and nitrogen oxides contents at the acceleration period are reduced by about 9% and 11%, respectively, and the carbon oxide and nitrogen oxides contents at normal cruising are reduced by 35% and 8%, respectively.

As is apparent from the described comparison test results (I), (II) and (III), in the employment of the improved plugs of the present invention, highly advantageous results are achieved in that the fuel consumption of the engine is remarkably decreased and at the same time amounts of the toxic gasses, such as carbon monoxide and nitrogen oxides, discharged from the engines are concurrently reduced.

It is not theoretically clear why the above described surprising advantageous results are obtained. However, it is considered to be likely that the formed wire members disposed in the vicinity of the spark gap of the improved plug exerts favorable influences on the propagation of the combustion flame and thus provides for uniform combustion in the engine and prevents any abnormal combustion which occurs in the combustion chamber with the use of conventional plugs. It is also considered a possibility that a combustion promoting action or catalytic action is effected by the formed wire members employed in the improved plugs of the present invention at the high temperatures of about 1,000°C or more caused by the combustion.

The improved plug of the present invention provides highly superior conditions when practically employed in the engine combustion chamber in that the fuel consumption of the engine is greatly decreased, and that it effectively prevents knocking of the engine which is caused by abnormal combustion in the combustion chamber, and that the amounts of the incompletely burned products and those of nitrogen oxides are concurrently greatly decreased.

While there have been described and illustrated preferred embodiments of the present invention, it is apparent that numerous alterations, omissions and additions may be made without departing from the spirit thereof.

I claim:

1. In an ignition plug including a metal outer shell and a central electrode supported by and electrically insulated from the shell and a side electrode extending from the shell toward said central electrode and forming therewith a spark gap, the improvement comprising a plurality of members formed of wire mounted to and projecting forwardly of said shell and delineating a space surrounding said spark gap, the distance between said wire members and said spark gap exceeding the width of said spark gap, and said plurality of wire members including at least one pair of wire members each having a horizontal linear portion substantially parallel to and coplanar with said side electrode.

2. An ignition plug according to claim 1, wherein said pair of wire members comprise a pair of generally square U-shaped wire members each having at least one leg secured to the shell.

3. An ignition plug according to claim 2, wherein said generaly square U-shaped wire members have thinner wire wrapped about its legs.

4. An ignition plug according to claim 1, wherein the wire forming said members is stiff under conditions prevailing in the cylinder of an internal combustion engine and has a melting point exceeding 1000°C.

5. An ignition plug according to claim 1, wherein said wire is made of a rigid metal selected from the group consisting of Cr, Mo, W, Ni, Ir and Pt.

6. An ignition plug according to claim 1, wherein said wire is thinner than said electrodes.

7. An ignition plug according to claim 1, wherein said wire is made of a rigid alloy which includes at least one element selected from the group consisting of Ni, Au, Co and Al.

8. An ignition plug according to claim 1, wherein said pair of wire members are a pair of laterally spaced generally L-shaped wire members with the vertical legs connected to the shell.

9. An ignition plug according to claim 8, further including an intermediate L-shaped member formed of twisted wire with a horizontal leg underlying the side electrode.

10. An ignition plug according to claim 8, wherein the wire forming said members is stiff under conditions prevailing in the cylinder of an internal combustion engine and has a melting point exceeding 1000°C.

11. An ignition plug according to claim 8, wherein said wire is made of a rigid metal selected from the group consisting of Cr, Mo, W, Ni, Ir and Pt.

12. An ignition plug according to claim 8, wherein said wire is made of a rigid alloy which includes at last one element selected from the group consisting of Ni, Au, Co and Al.

13. An ignition plug according to claim 8, wherein said wire is thinner than said electrodes.

* * * * *